US006125729A

United States Patent [19]

Mirabello

[11] Patent Number: 6,125,729

[45] Date of Patent: Oct. 3, 2000

[54] MULTIPLE HEADS CUTTING UNIT

[75] Inventor: Ernesto Mirabello, Vigevano, Italy

[73] Assignee: Atom S.p.A., Vigevano, Italy

[21] Appl. No.: 09/273,973

[22] Filed: Mar. 22, 1999

[30] Foreign Application Priority Data

May 5, 1998 [IT] Italy ..... MI980314 U

[51] Int. Cl.[7] ..... B26F 3/00

[52] U.S. Cl. ..... 83/177; 83/425.4; 83/940

[58] Field of Search ..... 83/177, 53, 171, 83/170, 936–941, 425.4, 508.3

[56] References Cited

U.S. PATENT DOCUMENTS

| | | | |
|---|---|---|---|
| 2,533,311 | 12/1950 | Chelborg et al. | 83/177 X |
| 4,006,656 | 2/1977 | Shinomiya | 83/177 X |
| 4,031,790 | 6/1977 | Arvidsson | 83/425.4 |
| 4,204,448 | 5/1980 | Pearl | 83/177 |
| 4,246,838 | 1/1981 | Pulver et al. | 83/177 X |
| 4,266,112 | 5/1981 | Niedermeyer | 83/53 X |
| 4,570,518 | 2/1986 | Burmeister et al. | 83/504 |
| 4,934,112 | 6/1990 | Jackson | 83/53 X |
| 5,083,487 | 1/1992 | Croteau | 83/53 X |
| 5,269,211 | 12/1993 | Flaming | 83/53 X |
| 5,458,034 | 10/1995 | Cavagna | 83/508.3 X |

*Primary Examiner*—Kenneth E. Peterson
*Attorney, Agent, or Firm*—Bucknam and Archer

[57] ABSTRACT

Multiple head cutting unit, especially suitable for machines utilized to cut leather, skin and synthetic materials with a water jet, including at least a carriage (16), movable along several axes with respect to an underlying work table (14) and a cutting unit supported by carriage (16) and including a nozzle for the outlet of pressurized water, wherein the cutting unit supported by carriage (16) includes at least two cutting heads (26, 36, 38), and at least one of said cutting heads is movable with respect to the other one or ones along a horizontal plane parallel to the work table (14).

4 Claims, 3 Drawing Sheets

MULTIPLE HEADS CUTTING UNIT

DESCRIPTION

The present invention relates to a multiple heads cutting unit. More particularly, the present invention relates to a multiple head cutting unit, especially suitable to be used in machines for cutting materials by a water jet, utilized for instance in the footwear and leather goods sector.

As is known, to obtain half-finished shaped products from leather, skin or synthetic material, specific machines are used called punching machines, provided with a beating arm or plate which compresses the variously shaped punches on the material to be cut, placed on the work table. The operator positions each time the shaped punch on the material to be cut and obtains, for each lowering of the beating plate, a half-finished product, for instance a shoe sole or parts of vamp thereof.

Another known cutting system utilized in this sector provides for the use of more complex machines, through which the material placed on the work table is submitted to the action of an operating head wherefrom a water jet comes at a very high pressure. The operating heat is provided with a nozzle having a very reduced section, so that the pressurized water is concentrated and forms a thread-thin jet that incises and goes though the leather, the skin or the synthetic material, obtaining the half-finished product in the shape and size desired. During the outlet of the water jet, the head, which stands above the work top, is continuously moved along the profile of the half-finished product to be obtained. Said head movement is electronically programmed, so that the operator needs not step in during the operation. The cutting program is not referred to only one piece, but to a plurality of pieces previously identified on the material by systems of optical survey or the like. This operating system allows therefore to obtain the cut of the whole piece of leather or sheet of material for each complete cycle of the machine and the ensuing forming of a multiplicity of half-finished products, without any intervention by the operator.

These water jet cutting machines, while being automated and precise, still have some drawbacks as concerns especially the overall duration of each complete working cycle. The operating head, in fact, must progressively shift to cover the whole area of the material wherefrom the half-finished products are to be obtained, which products are necessarily cut once at a time. Given the extension of the material, developed for several square meters, the duration of each operating cycle is therefore quite long.

In order to obviate this drawback, water jet cutting machines have been proposed, provided with two coupled work tables, each carrying an operating head; in this way, as the cutting operations are made at the same time on two fronts, in correspondence of two independent material surfaces, there is obtained a doubling of the production for each complete operating cycle.

However, this solution also is not devoid of drawbacks. A cutting machine with two work table involves in the first place remarkable overall dimensions, which are not always compatible with the space available. Another drawback is the cost of such a machine, which is very high; in fact, the addition of an operating head and of a work table involves in practice the realization of a second machine, to be coupled to the first one, complete with all its components, such as feeding means, basin with ducts for water collection, permeable support for the work table whereon the material is laid down, etc.

A further drawback is the necessity of performing each time hand adjustments of each operating head, to establish exactly the distance between centres to be maintained in the cutting of the various pieces. Such adjustments involve a remarkable waste of time, taking into account the fact that, sometimes, the half-finished products to be obtained from a same leather or sheet of material have sizes different from each other. On changing the type and size of the half-finished product it is therefore necessary to operate by hand to set up a new adjustment of the distances between centers of the operating heads.

The object of this invention is to obviate the above drawbacks. More particularly, the object of this invention is to provide a water jet cutting unit, especially suitable for cutting leather, skin or synthetic materials, having contained overall dimensions, provided with only one work table, and such as not to need continuous adjustments.

Another object of this invention is to provide a cutting unit able to obtain, in a quick, easy and economical manner, from the material placed on only one work table, the whole lot of half-finished product, without changing the structure of said group substantially, as concerns its size and the preparation of the composing parts.

A further object is to provide a cutting unit allowing to change easily and without complicated hand operations, the rate of one or more of the cutting heads, according to the different size of the half-finished products to be obtained from one individual skin or material.

According to the present invention, these and still other objects which will become clearer thanks to the following description, are achieved by a multiple head cutting unit particularly suitable for machines utilized to cut leather, skin and synthetic materials with a water jet, comprising at least a carriage, movable along several axes with respect to an underlying work table, and a cutting unit supported by said carriage and comprising a nozzle for the outlet of the pressurized water, wherein the cutting units supported by said carriage includes at least two cutting heads in number wherein and at least one of said cutting heads is movable with respect to the other one or ones along a horizontal plane parallel to the work table.

The constructive and functional characteristics of the multiple head cutting unit of the present invention shall be better understood thanks to the following description, wherein reference is made to the attached drawings which represent a preferred, non limiting embodiment of the same, and wherein.

Figure 1:
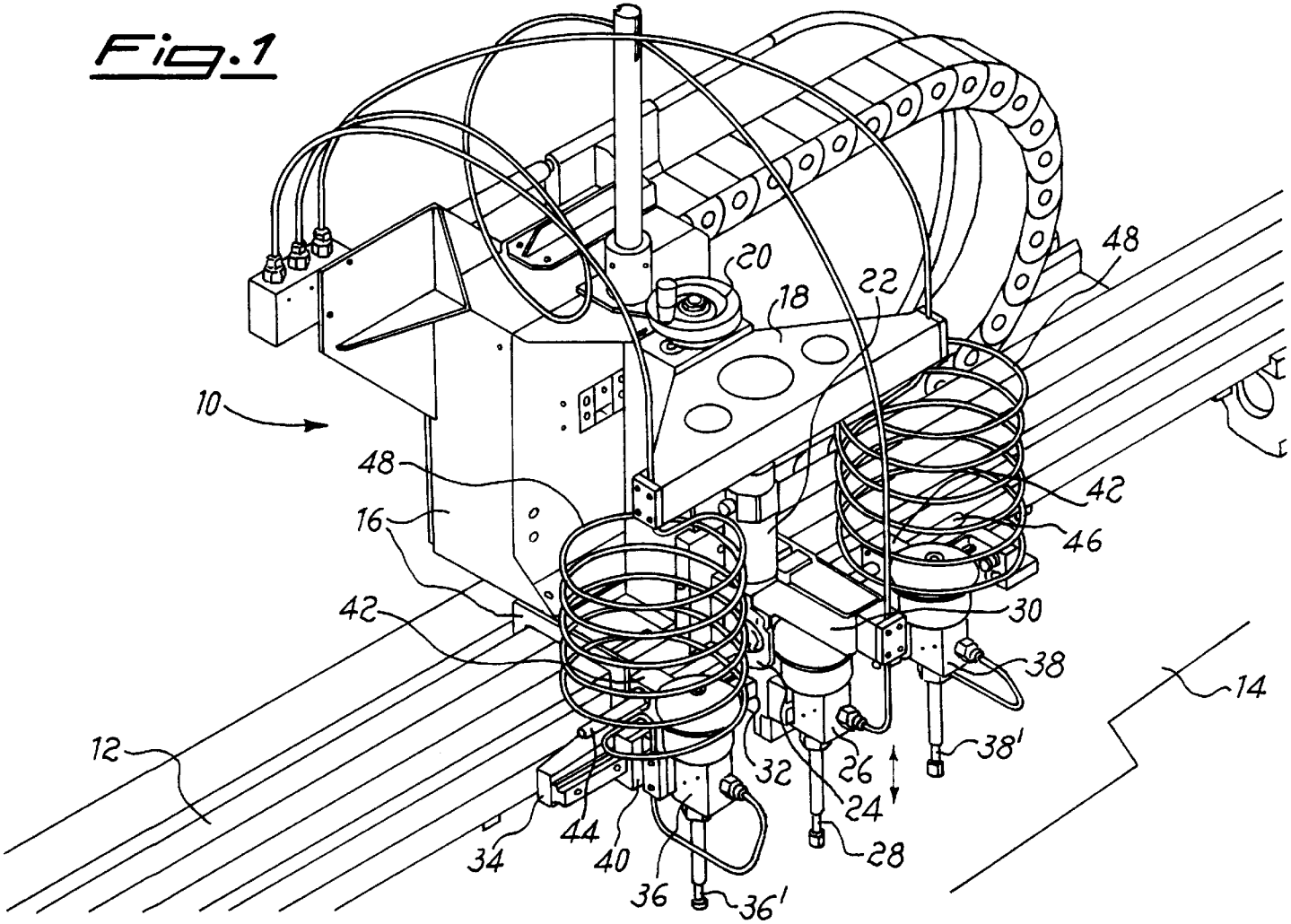
FIG. 1 is a schematic perspective view of the multiple head cutting unit of the invention.
Figure 2:
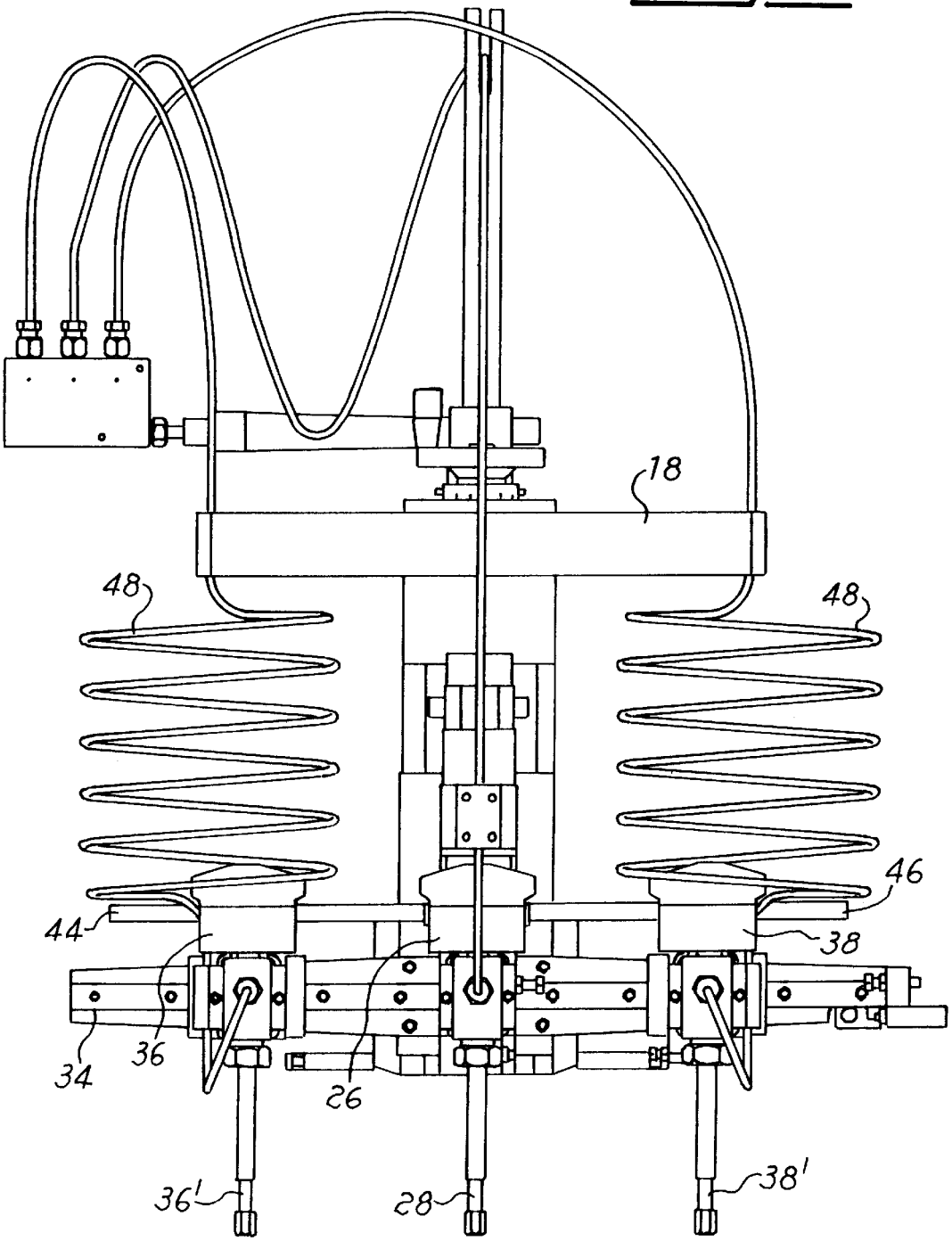
FIG. 2 is a schematic front view of the same cutting unit of FIG. 1.

In the aforementioned figures, the multiple head cutting unit of the present invention, indicated as a whole by 10, is applied to a water jet cutting machine which comprises a work table 14, of a suitable size, whereon there is laid down the material to be cut, which may be leather, skin or synthetic material, and an overhanging guide or longitudinal axis 12 for the sliding of said unit, parallel to said work top.

Said unit 10 comprises a carriage 16, for instance having the form of a turret, provided, on the front and in high position, with an integral plate-like element 18, having a plan, by way of example and not critically, trapezoidal.

Carriage 16 is coupled to the load-bearing frame of the machine (not shown in detail) and is provided with conventional means which allow, for instance through a handwheel 20, the adjustment of the height with respect to the aforementioned work table 14.

Said carriage 16 constitutes the support for the individual cutting units or heads 26, 36, 38 and for the related moving means for the mutual approach and removal. In particular, carriage 16 supports, in its central part, starting from the plate-like element 18, an electric motor 22 provided with a gearmotor 24. To said gearmotor 24 there is fixed, through an arm 30, a first cutting unit 26, provided with nozzle 28, wherefrom the pressurized water jet issues which acts on the material placed on the work table 14.

From the motor 22 gearmotor 24 unit, arm 30, carried by the plate-like element 18 and orthogonally oriented with respect to the longitudinal guide 12 of the machine, has a cantilever development in the front direction and moves parallel with respect to said work table 14.

Said first cutting unit or head 26, given the rigid connection with the motor-gearmotor unit 22, 24, and consequently, with the platelike element 18 of carriage 16, can move only vertically, perpendicular to the work table 14, correlated to the lowering or the lifting of said carriage with respect to said work table 14.

The enbloc formed by motor 22 and gearmotor 24 is provided in the lower part with a through-opening 32, oriented parallelly to the work table 14, wherein there is located and fastened with known means a guide 34 having a horizontal development, parallel to the work table.

Said guide 34, having the form of a shaped bar, develops with an extension preferably equal from the opposite fronts of opening 32, wherein it is inserted and constitutes the support for additional cutting units, as specified hereunder.

In the preferred embodiment of the figures, said additional cutting units or heads are in number, indicated by 36 and 38, located respectively at the left or right side of said first central unit 26 and aligned with the same. Each of said side units 36, 38 comprises a support 40 for the coupling and sliding along guide 34 and an integral upper body 42 provided with a transversely extended threaded through-hole.

The holes of said bodies 42, respectively of the side cutting unit 36 and of unit 38, have an opposite threading, i.e. right-hand in one of them and left-hand in the other one. Two opposite screws 44, 46 protruding from gearmotor 24, are inserted in the threaded holes of bodies 42, having a complementary threading.

The rotation of screws 44, 46, obtained through the activation of gearmotor 24, causes therefore the movement of said side cutting units 36, 38, with respect to the central one 26, along a plane parallel to the work table, approaching to, or removing from, said central cutting unit 26.

The side cutting units 33, 38 are obviously provided with a nozzle, indicated respectively by 36', 38' for the outlet of the pressurized water. Water is fed, at least as concerns the side cutting units 36, 38, by means of flexible ducts 48, partly coil-like wrapped to compensate for the sliding of said units along guide 34.

Figure 3:
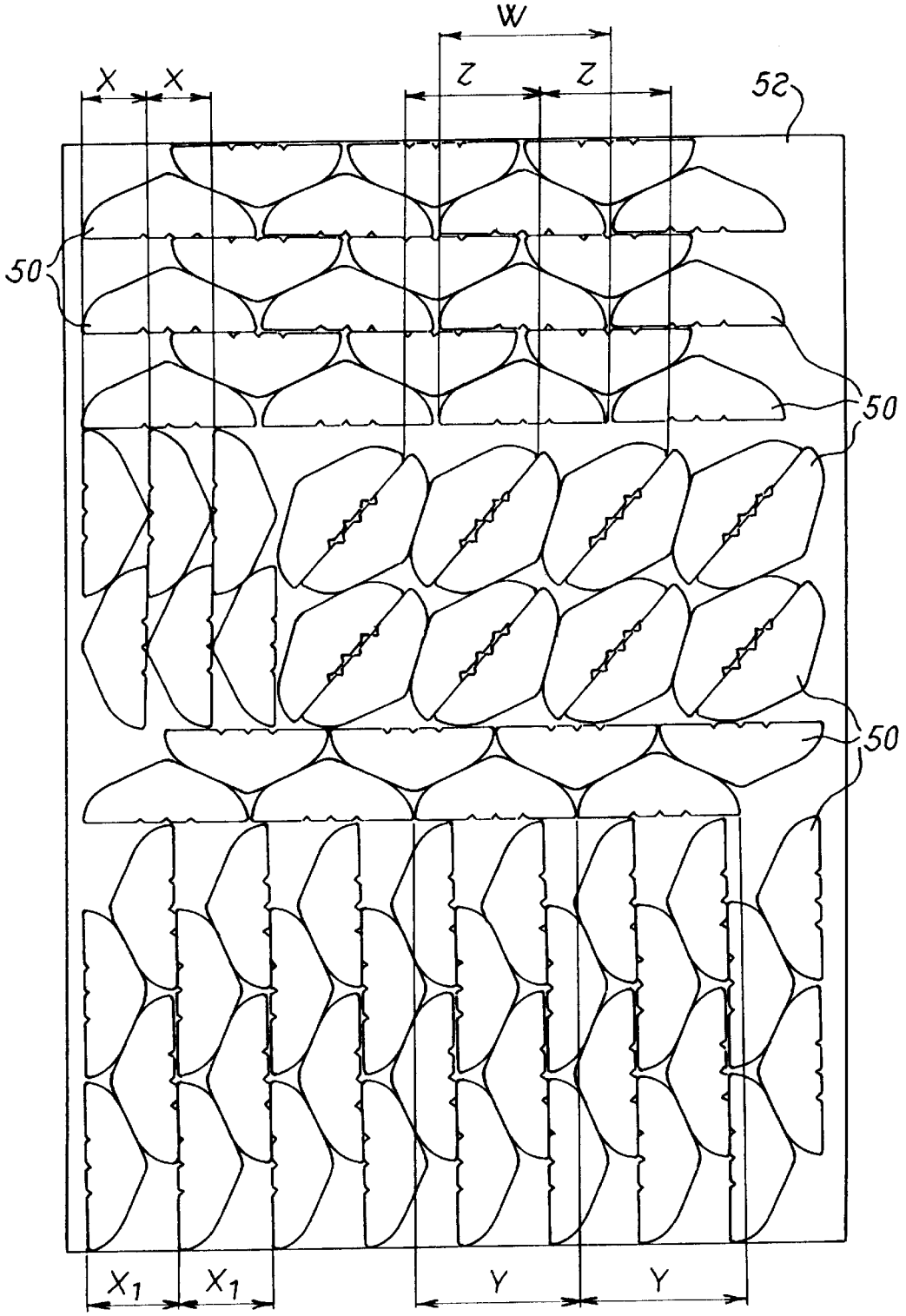
FIG. 3 is a schematic example of orientation of half-finished products different from each other, obtainable from a sheet of material, be it leather, skin or synthetic material.

The adjustment of the distance between the different cutting units, in particular of the side units 36, 38 with respect to the central one 26, may be obtained by means of length coders, encoders or the like, connected to the motor 22 and gearmotor 24 unit. This allows to change quickly and exactly the distance between centers of the artefacts to be obtained, as shown schematically in FIG. 3, which represents by way of example several forms of artefacts 50, obtainable by a sheet of material 52. From this figure it may be easily inferred that the distance between centres x, x1, y, z, w may be easily changed by modifying the orientation besides the dimensions of the artefact obtainable from the material. Besides, as the side cutting units 36, 38 are quickly movable away from the central one 26, the complete operating cycle is realized through substantially automated sequences, for instance by means of a simple adjustment of the values on a board connected to said length codifying means.

Still more advantageous, as may be easily understood from the above description, is the possibility of realizing at the same time a plurality of complete cutting operations on the material placed on only one work table, which possibility arises from the presence of several operating units connected with each other and coordinated or co-ordinable. With regard to this last aspect, the possibility must be stressed of activating not simultaneously all the cutting units, which is easily obtainable through the programming of the same in close correlation with the shape and size of the material.

The cutting unit of the present invention may be provided with a different number of units, greater or smaller with respect to what has been described and illustrated in the figures.

In the case of a greater number of units, for instance five, double supporting carriages and/or movement screws developed along different lines may be used.

Said units may be supported by one or more different carriages and/or independent guides or may be moved through differently located and/or activated screws, or by equivalent movement means.

While the present invention has been described above with reference to a preferred embodiment, various changes and variant may be made in the multiple head cutting units of the present invention, in the light of the above teaching. It is therefore understood that the present invention comprises all the changes and variants which fall within the spirit and the protection scope of the following claims.

What is claimed is:

1. A multiple head cutting unit for machines for cutting leather, skin and synthetic material with a water jet, comprising:

a) a carriage (16) movable along at least two axes with respect to an underlying work table (14);

b) a motor (22) and a gearmotor (24) forming a unit supported by said carriage (16), said gearmotor (24) having a through-opening (32) parallel to said work table (14) with a guide means (34) located and fixed therein parallel to said work table (14), said gearmotor (24) having two opposite screws (44,46) protruding therefrom;

c) a cantilever arm (30) parallel to said work table (14) and fixed to said gearmotor (24);

d) a first cutting unit (26) fixedly supported on said cantilever arm (30); and e) two laterally arranged cutting units (36, 38) disposed on each side of said first cutting unit (26) and aligned therewith, said two lateral cutting units (36, 38) being slidingly supported by said guide means (34) so as to approach to or remove from said first cutting unit (26) and each including an integral body (42) having a threaded through-hole extending transversely wherein the thread of the through-hole of one of said lateral cutting units (36) is opposite the thread of the through-hole of the other one of said lateral cutting units (38) and the opposite screws (44,46) with complimentary thread are received therein, said first cutting unit (26) and said two laterally arranged cutting units (36, 38) include pressurized water outlet nozzles.

2. The multiple head cutting unit as defined in claim 1, which further comprises means (20) for moving said carriage (16) perpendicular to said work table (14).

3. The multiple cutting unit as defined in claim 1, wherein said two laterally arranged cutting units (36, 38) each include coupling means (40) for sliding support on said guide means (34).

4. The multiple cutting unit as defined in claim 1, wherein said two laterally arranged cutting units (36, 38) each are provided with a flexible duct (48), partly coil-like wound, for water feed.

* * * * *